US010013959B2

(12) United States Patent
Kim

(10) Patent No.: US 10,013,959 B2
(45) Date of Patent: Jul. 3, 2018

(54) REED FOR MOUTHPIECE OF WIND INSTRUMENT

(71) Applicants: Du Han Kim, Seoul (KR); Sung Tack Lim, Seoul (KR)

(72) Inventor: Du Han Kim, Seoul (KR)

(73) Assignee: Sung Tack Lim, Seoul (KR)

( * ) Notice: Subject to any disclaimer, the term of this patent is extended or adjusted under 35 U.S.C. 154(b) by 0 days.

(21) Appl. No.: 15/681,925

(22) Filed: Aug. 21, 2017

(65) Prior Publication Data

US 2018/0102114 A1 Apr. 12, 2018

(30) Foreign Application Priority Data

Oct. 6, 2016 (KR) ..... 10-2016-0129042

(51) Int. Cl.
*G10D 9/02* (2006.01)
*G10D 7/08* (2006.01)

(52) U.S. Cl.
CPC ..... *G10D 9/023* (2013.01); *G10D 7/08* (2013.01)

(58) Field of Classification Search
None
See application file for complete search history.

(56) References Cited

U.S. PATENT DOCUMENTS 1,506,364 A * 8/1924 Marius ..... G10D 9/023 84/383 A
1,667,836 A * 5/1928 Brockman, Jr. ..... G10D 9/023 84/383 A
2,342,836 A * 2/1944 Arnold ..... G10D 9/023 84/383 A
2,669,897 A * 2/1954 Jacob ..... G10D 9/023 84/283
2,775,273 A * 12/1956 Yost ..... G10D 9/023 144/196
3,420,132 A * 1/1969 Backus ..... G10D 9/023 84/383 A
5,479,842 A * 1/1996 Ostermeyer ..... G10D 9/023 427/388.4
6,747,198 B1 6/2004 Sullivan
8,766,072 B2 * 7/2014 Ku ..... G10D 9/023 84/383 A
2005/0061137 A1 * 3/2005 Rovner ..... G10D 9/023 84/383 A
2018/0102114 A1 * 4/2018 Kim ..... G10D 9/023

FOREIGN PATENT DOCUMENTS

KR 20-0456255 Y1 10/2011
KR 10-1151231 B1 6/2012
KR 20-0473389 Y1 7/2014

* cited by examiner

*Primary Examiner* — Robert W Horn
(74) *Attorney, Agent, or Firm* — KORUS Patent, LLC; Seong Il Jeong

(57) ABSTRACT

Disclosed herein is a reed for the mouthpiece of a wind instrument. The reed includes a vibration plate and a support plate. A tunnel-type hole is formed across the support plate in a lengthwise direction from one end surface of the support plate toward the vibration plate. The tunnel-type hole is a long blind hole whose one end on the one end surface is open and whose remaining end is closed, and is disposed in a lateral direction.

1 Claim, 6 Drawing Sheets

REED FOR MOUTHPIECE OF WIND INSTRUMENT

BACKGROUND

1. Technical Field

The present invention relates generally to a reed for the mouthpiece of a wind instrument, which generates sound by vibrating an air column inside a mouthpiece when a player blows over the read, and more particularly to a reed for the mouthpiece of a wind instrument, in which a tunnel-type hole is formed from one end surface of the support plate of the reed in a lengthwise direction, and thus strong resonance is generated and large amplitude vibrations, generated in a vertical direction identical to that of the vibration plate of the reed, are transferred to an air current inside a mouthpiece, thereby generating deep sound having a strong resonance.

2. Description of the Related Art

A conventional reed for the mouthpiece of a wind instrument is shown in FIGS. 1 and 2.

FIG. 1 is an exploded perspective view showing the mouthpiece assembly of a typical saxophone. In the mouthpiece assembly of the typical saxophone, an outer wall inclined on one side of a tubular mouthpiece 10 forms a baffle 11, and a curved tip rail 13 is formed by crossing the baffle 11 and a flat coupling surface 12. The coupling surface 12 extends from the tip rail 13, and defines an inner air chamber 14. A reed 16 is coupled to the coupling surface 12 by a ligature (not shown).

FIG. 2 is a sectional view showing the operation of the mouthpiece assembly of the typical saxophone. In the mouthpiece assembly, air enters into the air chamber 14 via a tip opening between the tip rail 13 and the reed 16 and generates a vibration frequency through the operation of resiliently pushing the baffle 11 and the reed 16 against each other, sound is generated via the vibration frequency, and vibrations are generated in the inner space of the air chamber 14, thereby enabling the musical instrument to generate sound. The reed 16 basically includes a vibration plate and a support plate.

The vibration plate is a plate having one tapered surface, and the support plate is a plate having one convex curved surface. The other surfaces of the vibration plate and the support plate are flat surfaces, and only the other surface of the vibration plate comes into contact with a mouthpiece 10.

The support plate is fastened to the mouthpiece 10 by a binder (not shown) in the state where the support plate has been brought into contact with one surface 12 of the mouthpiece 10.

When a player plays a wind instrument, the unfastened vibration plate vibrates vertically, and transfers vibrations to an air current entering into the mouthpiece 10, thereby finally generating a sound.

However, only vibrations attributable to the vertical shaking of the vibration plate are transferred to an air current inside the mouthpiece 10, and thus the echo of a sound is not strong, with the result that only a person having large lung capacity can desirably generate a sound.

In order to overcome this problem, patent document 1 (Korean Utility Model Registration No. 20-0456255) discloses a conventional reed for the mouthpiece of a wind instrument.

As shown in FIGS. 2 and 3, the conventional reed for the mouthpiece of a wind instrument is used in combination with the mouthpiece of a wind instrument, such as a saxophone. The conventional reed for the mouthpiece of a wind instrument includes: a rod-shaped support plate 10 configured such that the top thereof is formed in a curved shape; and s vibration plate 20 configured to extend from the support plate 10 in an integrated manner, to be formed in a lengthwise direction, and to have a tapered surface inclined toward one end thereof.

The top of the support plate 10 is provided with an echo portion 100 provided with a coupling protrusion 110, and is also provided with a cover 200 formed to correspond to the coupling protrusion 110 of the echo portion 100 and configured to seal the echo portion 100.

Accordingly, a sound attributable to the vibrations of a reed resonates inside the echo portion 100, i.e., a sealed space, and thus advantages arise in that the sound of a musical instrument is made long and full regardless of the material of the reed, thereby enabling effective playing, and in that even a beginner can easily generate a desired sound.

However, the echo portion 100 is formed in a direction perpendicular to the lengthwise direction of the support plate 10. Accordingly, even when vibrations generated by the vertical shaking of the vibration plate 20 are transferred to the support plate 10, the transferred vibrations reach one side due to the upright position of the echo portion 100 identical to that of a wall, and thus resonance generated inside the echo portion 100 is not strong.

Furthermore, even when resonance is generated inside the echo portion 100 and the support plate 10 vibrates, the support plate 10 vibrates in a front-back direction rather than an up-down direction, and thus vibration efficiency inside the mouthpiece is considerably low.

Furthermore, resonance inside the echo portion 100 allows vibrations to be transferred to the mouthpiece via only the bottom of the echo portion 100 (i.e., a surface corresponding to the cover), and thus a vibration contact area is considerably small.

Meanwhile, patent document 2 (Korean Patent No. 10-1151231) discloses another conventional reed 100 for the mouthpiece of a wind instrument.

As shown in FIGS. 5 and 6, in the reed 100 for the mouthpiece of a wind instrument disclosed in patent document 2, a slit 180 is formed through the curve surface 170 of a support plate 101 in a lengthwise direction.

However, the slit 180 is a space whose front, back and bottom are open, and rarely generates large amplitude through the generation of resonance.

In other words, even when the vibrations of a vibration plate are transferred to the support plate 101, the slit 180 of the support plate 101 cannot generate resonance by using the vibrations, and thus cannot transfer the vibrations to an air current inside a mouthpiece.

Furthermore, the slit 180 may cause splitting or deformation around itself like a notch formed in a lengthwise direction.

SUMMARY

The present invention has been conceived to overcome the above-described problems, and an object of the present invention is to provide a reed for the mouthpiece of a wind instrument, which can desirably generate a resonance phenomenon and has directionality adapted to desirably transfer the amplitude of vibrations, generated by the resonance phenomenon, to a mouthpiece.

According to the present invention, there is provided a reed for the mouthpiece of a wind instrument, the reed including a vibration plate and a support plate; wherein a tunnel-type hole is formed across the support plate in a lengthwise direction from one end surface of the support plate toward the vibration plate; and wherein the tunnel-type hole is a long blind hole whose one end on the one end surface is open and whose remaining end is closed, and is disposed in a lateral direction.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Preferred embodiments of the present invention will be described in detail below with reference to the accompanying drawings. The same reference symbols will be assigned to components which are the same as conventional components, and redundant detailed descriptions thereof will be omitted.

The present inventor has looked for the reason why a player needs to blow air hard when he or she plays a wind instrument and why resonance is not strong and a deep sound is not generated, and has found that the reason is that vibrations attributable to resonance are very weak inside the support plate of a reed supported on a mouthpiece.

Accordingly, in order to increase a resonance phenomenon, a depression was formed through the curved surface of a support plate in a lengthwise direction perpendicular to the curved surface, as in patent document 1. When the vibrations of a vibration plate were transferred to the vertical depression, the vibrations almost cancelled out each other, and thus resonance was very weak. Furthermore, vibrations attributable to the very weak resonance had directionality toward all directions including a vertical direction, and thus vibrations were rarely transferred to the inside of the mouthpiece.

Meanwhile, a slit having a U-shaped section was formed through a curved surface in a lengthwise direction, as in patent document 2. Since the front, back and top of the slit were open, and thus resonance was rarely generated.

The present inventor has found that the depression perpendicular to a lengthwise direction (see patent document 1) and the slit having an open front, back and top (patent document 2) generate a weak resonance phenomenon and have a problem with the directionality of vibrations, and has come up with the shape of the inner space of a bell as a shape which desirably generates resonance and desirably transfers vibrations attributable to the resonance to the inner space of a mouthpiece.

A bell has an inner space having an open top. In the inner space of the bell, resonance is desirably generated, and lingers beautifully. A tunnel-type hole having a shape similar to that of the inner space of a bell is formed from one end surface of a support plate across the support plate in a lengthwise direction. It has been found that resonance is desirably generated inside the tunnel-type hole and vibrations attributable to the resonance have directionality which ensures the desirable transfer of the vibrations to the inside of the mouthpiece.

Figure 1:
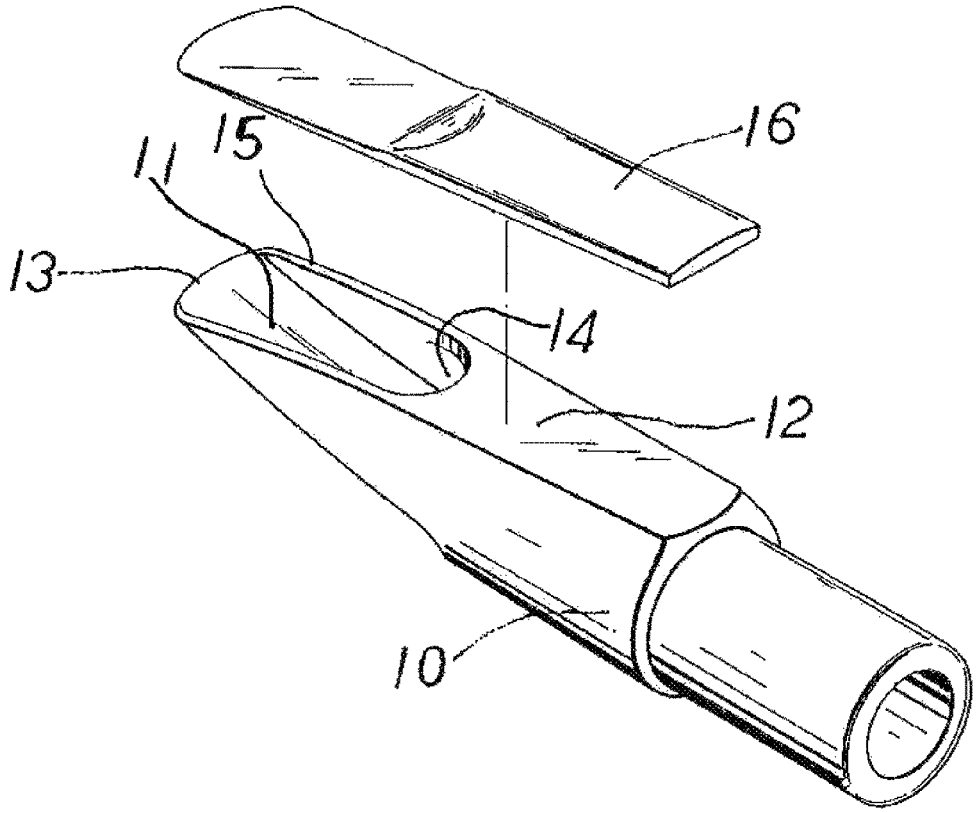
FIG. 1 is an exploded perspective view showing the mouthpiece assembly of a typical saxophone.
Figure 2:
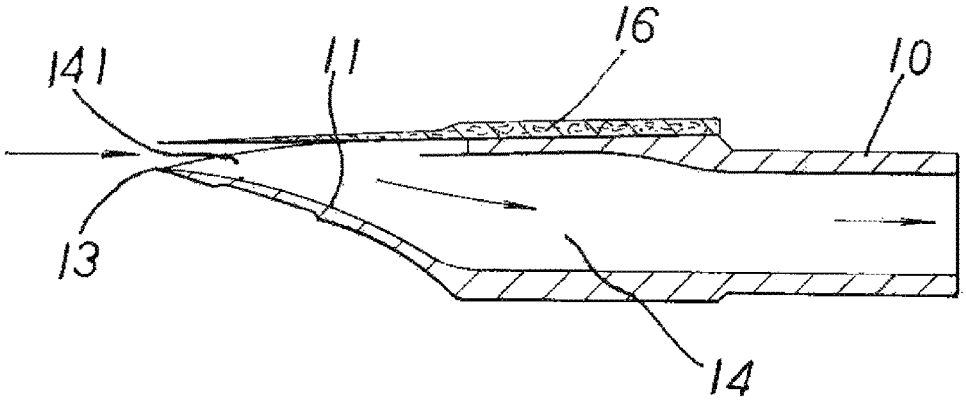
FIG. 2 is a sectional view showing the operation of the mouthpiece assembly of the typical saxophone.
Figure 3:
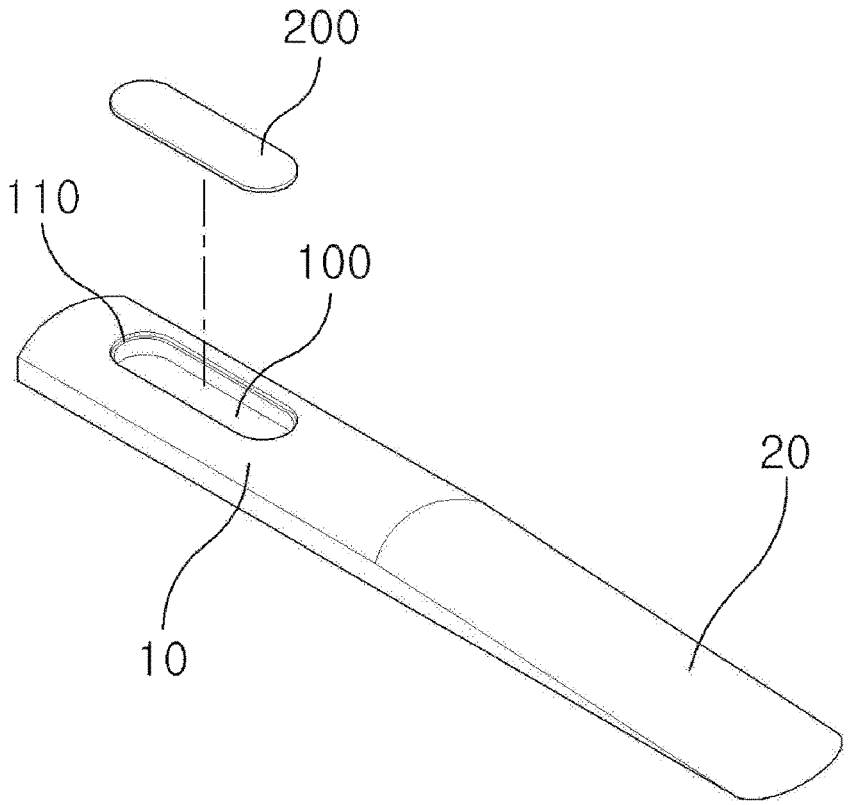
FIG. 3 is an exploded perspective view showing a conventional reed for a musical instrument, which is provided with an echo portion.
Figure 4:
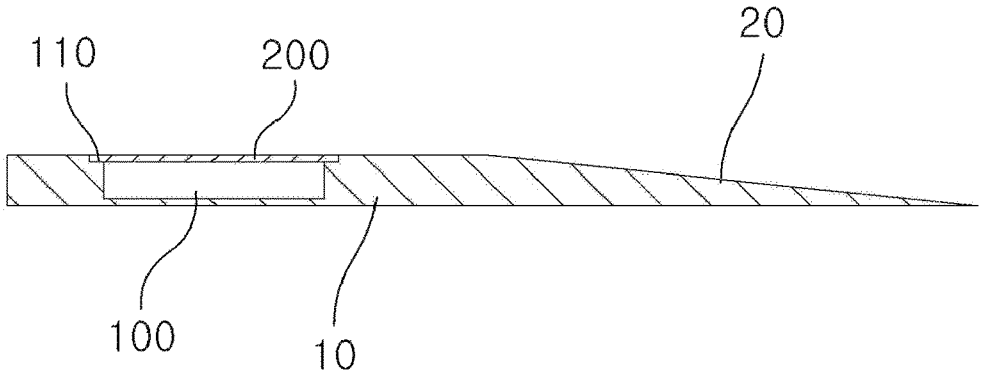
FIG. 4 is a longitudinal sectional view of FIG. 3.
Figure 5:
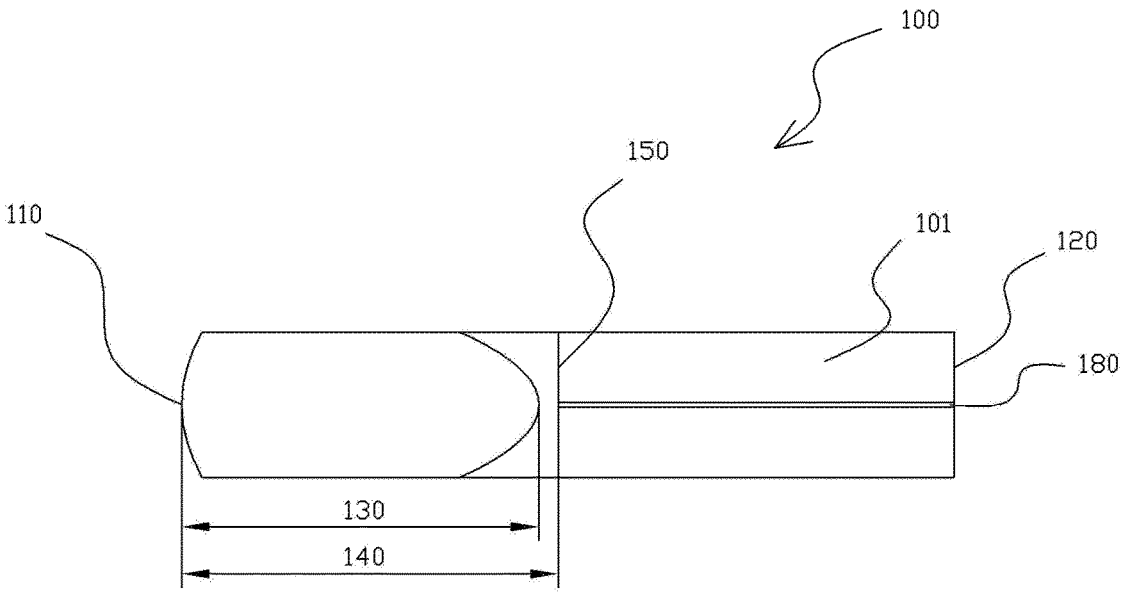
FIG. 5 is a plan view showing another conventional reed for a saxophone.
Figure 6:
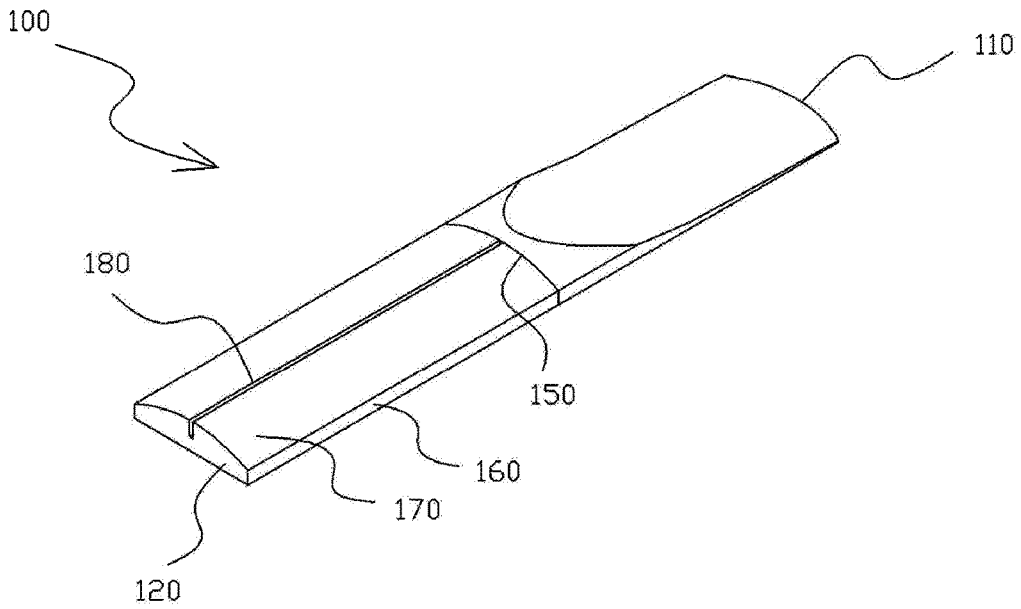
FIG. 6 is a perspective view showing the other conventional reed for a saxophone.
Figure 7:
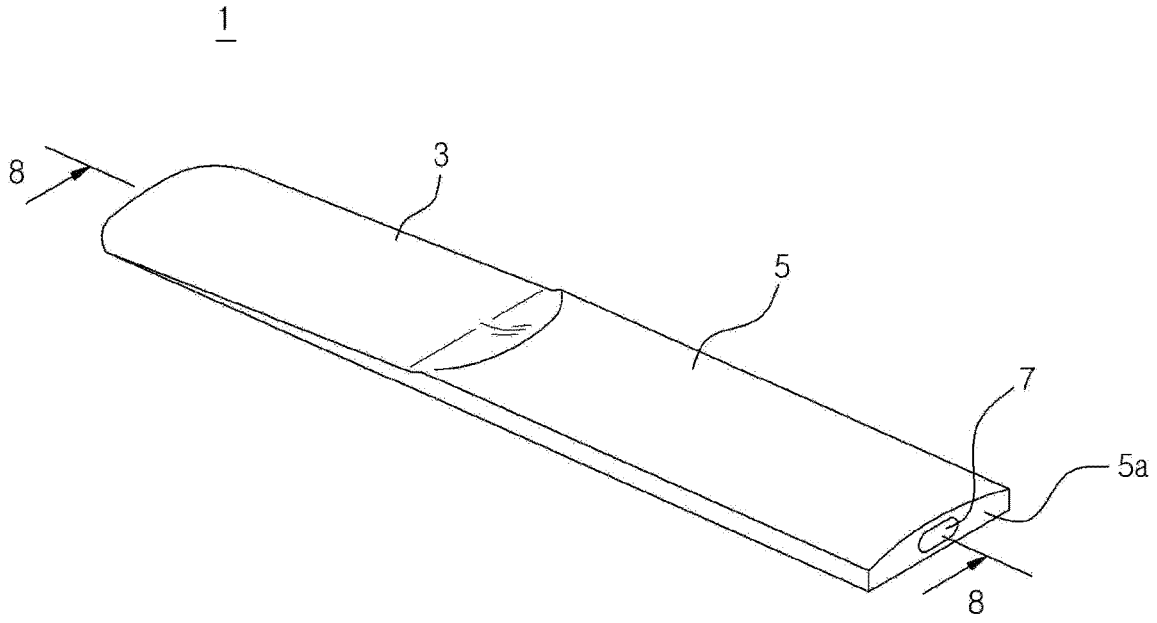
FIG. 7 is a perspective view showing a reed for the mouthpiece of a wind instrument according to a preferred embodiment of the present invention.
Figure 8:
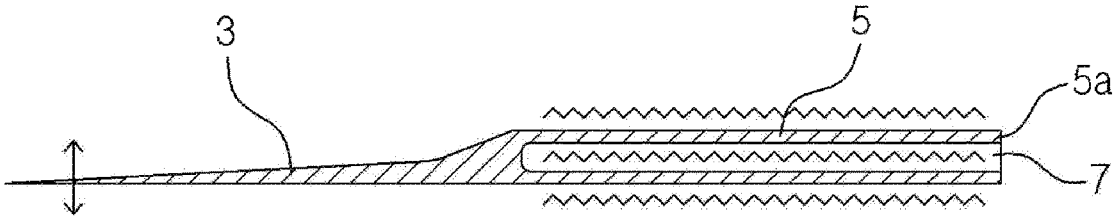
FIG. 8 is a sectional view taken along line 8-8 of FIG. 7.
Figure 9:
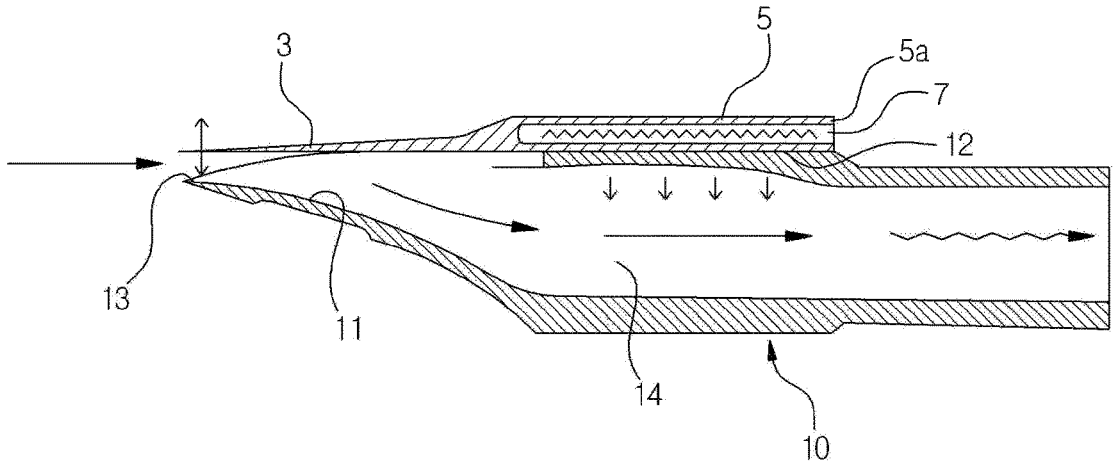
FIG. 9 is a view illustrating the transfer of vibrations to a mouthpiece via the reed of FIG. 7.
Figure 10:
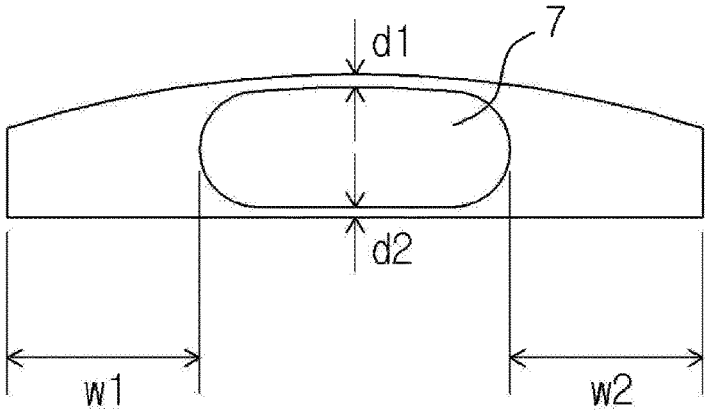
FIG. 10 is a front view of FIG. 7.
Figure 11:
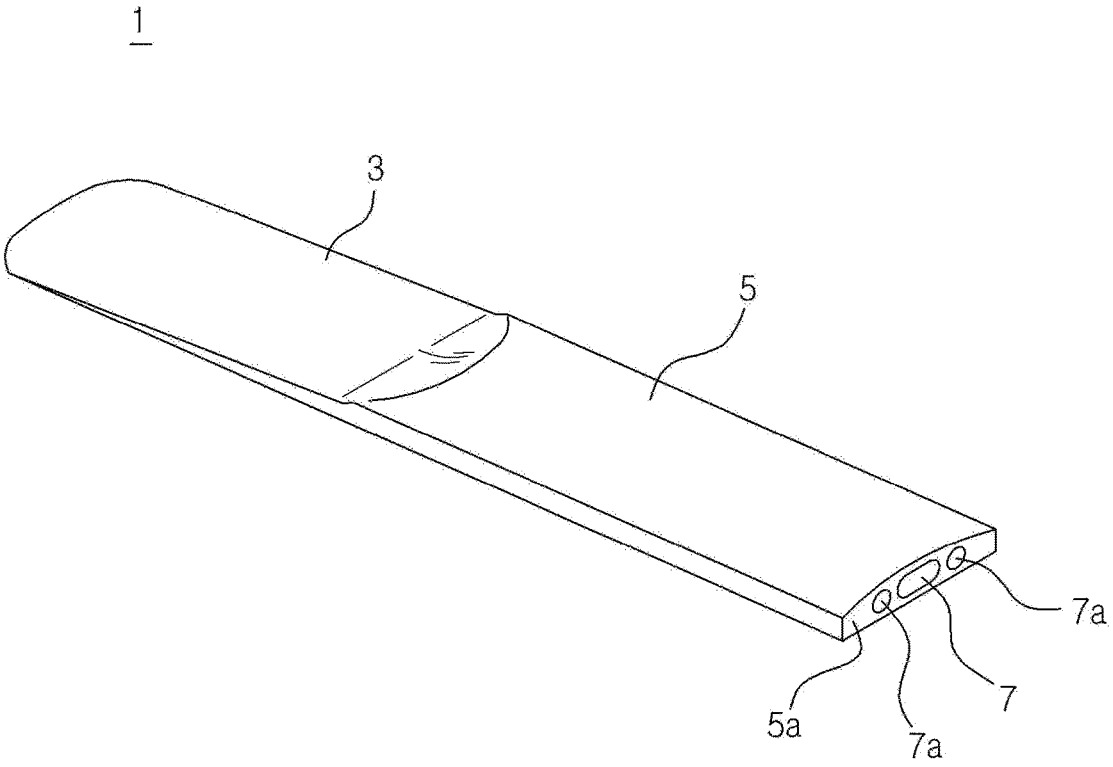
FIG. 11 is a perspective view showing a reed for the mouthpiece of a wind instrument in which a plurality of tunnel-type holes is formed according to a preferred embodiment of the present invention.

FIG. 7 is a perspective view showing a reed 1 for the mouthpiece of a wind instrument according to a preferred embodiment of the present invention, FIG. 8 is a sectional view taken along line 8-8 of FIG. 7, FIG. 9 is a view illustrating the transfer of vibrations to a mouthpiece via the reed of FIG. 7, FIG. 10 is a front view of FIG. 7, and FIG. 11 is a perspective view showing a reed for the mouthpiece of a wind instrument in which a plurality of tunnel-type holes is formed according to a preferred embodiment of the present invention.

As shown in FIGS. 7 to 9, the reed 1 for the mouthpiece of a wind instrument according to the present embodiment includes a vibration plate 3 and a support plate 5.

As shown in FIG. 9, air blown by a player enters into an air chamber 14 via a tip opening between the vibration plate 3 and a tip rail 13 and generates a vibration frequency through the operation of resiliently pushing a baffle 11 and the vertically vibrating vibration plate 3 against each other, a sound is generated via the vibration frequency, and vibrations are generated inside the inner space of the air chamber 14, thereby enabling a musical instrument to generate sound.

One surface of the vibration plate 3 is a flat surface, and the other surface of the vibration plate 3 is an inclined surface whose height increases gradually toward the support plate 5.

One surface of the support plate 5 is a flat surface which is level with the one surface of the vibration plate 3, and the other surface of the support plate 5 is a convex surface whose heights are kept uniform.

Furthermore, the support plate 5 is fastened and supported by a fastener (not shown) in the state where the one surface of the support plate 5 has been brought into contact with a coupling surface 12, as shown in FIG. 9.

In particular, a tunnel-type hole 7 is formed across the support plate 5.

The tunnel-type hole 7 is formed in a lengthwise direction from an end 5*a* of the support plate 5 toward the vibration plate 3.

In other words, the tunnel-type hole 7 is a blind hole closed at one end thereof, and is formed in a lateral direction.

The blind hole closed at one end thereof is similar to the internal shape of a bell, and thus generates a deep lingering resonance.

Furthermore, as shown in FIGS. 8 and 9, in connection with the tunnel-type hole 7 disposed in a lateral direction, vibrations attributable to the vertical shaking of the vibration plate 3 are transferred to the support plate 5, a resonance phenomenon occurs inside the tunnel-type hole 7, and the resonance is directly transferred to the support plate 5 and causes vertical shaking. Most of the vertical shaking is transferred to the inside of the air chamber 14 without change via the coupling surface 12.

The vibrations of the support plate 5 transferred to the inside of the air chamber 14 add vibrations to an air current blown by a player and thus increase a vibration frequency, thereby generating a strong and deep sound.

Furthermore, since vibrations are added to an air current, it is sufficient if a player blows less for the same sound, and thus respiratory control is considerably facilitated.

Furthermore, as shown in FIG. 10, the tunnel-type hole 7 is disposed at the center of an end surface 5*a* in order to maximize the size of the tunnel-type hole 7, is configured in a shape in which the thicknesses d1 and d2 of upper and lower walls are considerably less than the thicknesses w1 and w2 of left and right walls, and is preferably formed to have an elliptical sectional shape.

In other words, the upper and lower walls are formed in the shape of a thin film. The inner surfaces of the upper and lower walls are curved surfaces. The thicknesses w1 and w2 of the left and right walls are substantially the same, and are considerably larger than the thicknesses d1 and d2 of the upper and lower walls. The bottoms of the left and right walls are flat surfaces.

The tunnel-type hole 7 is formed in a shape maximally similar to the shape of a bell (a shape whose thickness is significantly smaller than that of an inner empty space) by making the thicknesses of outer walls, surrounding the tunnel-type hole 7, maximally smaller than the inner space of the tunnel-type hole 7. The reason for this is that this shape enables resonance to be desirably generated, thereby enabling a maximum vibration frequency to be obtained.

Meanwhile, as shown in FIG. 11, tunnel-type holes 7*a* may be further formed on the right and left sides of the tunnel-type hole 7.

The number of tunnel-type holes 7 and 7*a* may be determined based on the type of wind instrument.

The shape of the walls between the tunnel-type hole 7 and the tunnel-type holes 7*a* is the shape of concave lenses. The reason for this is that this shape enables a plurality of holes to be formed in a shape similar to that of the inner space of a bell.

The cross section of the tunnel-type hole 7 may have a circular shape, an elliptical shape, or the like based on the type of musical instrument.

Furthermore, the reed 1 for the mouthpiece of a wind instrument may be made of a reed plant or synthetic resin.

As described above, the present inventor has researched into how to desirably transfer the vibrations of the support plate 5 to the inside of the air chamber 14, and has reached the present invention in which the tunnel-type hole 7 is formed, the support plate 5 has a bell-shaped inner space, and the tunnel-type hole 7 is disposed in a lateral direction identical to the direction of an air current inside the air chamber 14. As a result, the vibrations of the support plate 5 attributable to resonance inside the tunnel-type hole 7 are transferred to the walls of the air chamber 14 without change, thereby considerably increasing the vibration frequency of an air current inside the mouthpiece 10.

According to the present invention, the following advantages are achieved:

The tunnel-type hole is formed from one end surface of the support plate across the support plate, and thus the support plate receives vibrations from the vibration plate, vibrates vertically around the tunnel-type hole due to resonance and transfers vibrations to an air current inside the mouthpiece, thereby generating a deep sound having a strong resonance.

In particular, the tunnel-type hole is disposed in a lateral direction, i.e., a lengthwise direction, and the bottom of the tunnel-type hole is close to the mouthpiece, thereby maximally transferring vibrations to an air current inside the mouthpiece.

Furthermore, the tunnel-type hole performs a function similar to the function of the inner space of a bell which generates significantly strong resonance, and thus vibrations transferred to the support plate generates strong resonance in the inner space of the tunnel-type hole and the resonance is, in turn, transferred to the support plate, thereby enabling the vertical vibrations of the support plate to greatly vibrate an air current inside the mouthpiece.

Although the present invention has been described with reference to the preferred embodiments of the present invention as described above, it will be apparent to those skilled in the art that the present invention may be modified or varied in various manners without departing from the spirit and scope of the present invention set forth in the attached claims.

What is claimed is:

1. A reed for a mouthpiece of a wind instrument, the reed comprising a vibration plate and a support plate;

wherein a tunnel-type hole is formed across the support plate in a lengthwise direction from one end surface of the support plate toward the vibration plate; and wherein the tunnel-type hole is a long blind hole whose one end on the one end surface is open and whose remaining end is closed, and is disposed in a lateral direction.

* * * * *